US005636349A

United States Patent [19]

Landa et al.

[11] Patent Number: 5,636,349

[45] Date of Patent: *Jun. 3, 1997

[54] METHOD AND APPARATUS FOR IMAGING USING AN INTERMEDIATE TRANSFER MEMBER

[75] Inventors: Benzion Landa, Edmonton, Canada; Ishaiau Lior, Ness Ziona; Hanna Pinhas, Holon, both of Israel

[73] Assignee: Indigo N.V., Sm Veldhoven, Netherlands

[ * ] Notice: The term of this patent shall not extend beyond the expiration date of Pat. No. 5,555,185.

[21] Appl. No.: 116,198

[22] Filed: Sep. 3, 1993

Related U.S. Application Data

[63] Continuation of Ser. No. 293,456, Jan. 4, 1989, abandoned.

[30] Foreign Application Priority Data

Sep. 8, 1988 [GB] United Kingdom ..... 8821108
Oct. 4, 1988 [GB] United Kingdom ..... 8823256

[51] Int. Cl.[6] ..... G03G 15/16

[52] U.S. Cl. ..... 399/307; 399/308

[58] Field of Search ..... 355/256, 271, 355/273, 277, 279, 286, 290; 219/216, 469, 470; 430/126

[56] References Cited

U.S. PATENT DOCUMENTS

| | | | |
|---|---|---|---|
| 3,245,511 | 4/1966 | Macklin . | |
| 3,318,212 | 5/1967 | Rubin | 355/281 |
| 3,394,245 | 7/1968 | Waldrop | 219/469 |
| 3,591,276 | 7/1971 | Byrne | 355/290 X |
| 3,669,706 | 6/1972 | Sanders et al. | 430/126 |
| 3,671,118 | 6/1972 | Fantuzzu et al. | 355/319 |
| 3,697,171 | 10/1972 | Sullivan | 430/126 |
| 3,746,448 | 7/1973 | Kitch | 219/216 |

(List continued on next page.)

FOREIGN PATENT DOCUMENTS

| | | |
|---|---|---|
| 0147341 | 7/1985 | European Pat. Off. . |
| 0181723 | 5/1986 | European Pat. Off. . |
| 3211905 | 5/1985 | Germany . |
| 56-123583 | 9/1981 | Japan . |
| 57-2048 | 1/1982 | Japan . |
| 61-117582 | 6/1986 | Japan . |
| 62-134674 | 6/1987 | Japan . |
| 62-134671 | 6/1987 | Japan . |
| 62-240987 | 10/1987 | Japan . |

(List continued on next page.)

OTHER PUBLICATIONS

English Language Abstract of JP– 56–123583 (Abstract only considered).

English Language Abstract of JP– 59–30571 (Abstract only considered).

English Language Abstract of JP– 55–164855 (Abstract only considered).

(List continued on next page.)

*Primary Examiner*—Joan H. Pendegrass
*Attorney, Agent, or Firm*—Greenblum & Bernstein P.L.C.

[57] ABSTRACT

An imaging apparatus including an image bearing surface having formed thereon a liquid image comprising carrier liquid and toner particles, an intermediate transfer member positioned in operative association with the image bearing surface, a first transfer station at which the liquid image is transferred from the image bearing surface onto the intermediate transfer member, and a second transfer station at which the liquid image is transferred from the intermediate transfer member onto a substrate including a source of heat which heats the intermediate transfer member and the liquid image so as to cause the toner to adhere to the substrate and whereat the intermediate transfer member and the liquid image are cooled sufficiently such that the adhesion of the toner to the intermediate transfer member is less than the cohesion of the toner.

101 Claims, 7 Drawing Sheets

U.S. PATENT DOCUMENTS

| | | | |
|---|---|---|---|
| 3,809,854 | 5/1974 | Sanders | 219/216 |
| 3,813,516 | 5/1974 | Kudsi et al. | 219/216 X |
| 3,838,919 | 10/1974 | Takahashi | 355/327 |
| 3,839,032 | 10/1974 | Smith et al. | 355/256 X |
| 3,839,919 | 10/1974 | Mollen et al. | 74/197 |
| 3,847,478 | 11/1974 | Young | 355/274 |
| 3,851,964 | 12/1974 | Smith et al. | 355/280 |
| 3,863,603 | 2/1975 | Buckley et al. | 355/273 |
| 3,893,761 | 7/1975 | Buchan et al. | 355/272 |
| 3,937,919 | 2/1976 | Clerx et al. | 219/216 |
| 3,948,215 | 4/1976 | Namiki | 118/60 |
| 3,959,574 | 5/1976 | Seanor et al. | 492/56 |
| 4,000,242 | 12/1976 | Hartbauer | 264/284 |
| 4,001,544 | 1/1977 | Heinzer et al. | 219/216 |
| 4,015,027 | 3/1977 | Buchan et al. | 427/22 |
| 4,144,808 | 3/1979 | Iwasa et al. | 101/494 |
| 4,145,599 | 3/1979 | Sakurai et al. | 219/216 |
| 4,163,892 | 8/1979 | Komatsu et al. | 219/216 |
| 4,219,327 | 8/1980 | Idstein | 219/216 X |
| 4,272,872 | 6/1981 | Hess et al. | 355/85 X |
| 4,286,039 | 8/1981 | Landa et al. | 430/119 |
| 4,395,109 | 7/1983 | Nakajima et al. | 355/289 X |
| 4,411,976 | 10/1983 | Landa et al. | 430/114 |
| 4,420,680 | 12/1983 | Itoh | 219/469 |
| 4,430,412 | 2/1984 | Miwa et al. | 430/126 |
| 4,453,820 | 6/1984 | Suzuki | 355/279 |
| 4,455,523 | 6/1984 | Koenck | 320/43 |
| 4,512,649 | 4/1985 | Derimiggio | 355/285 |
| 4,514,486 | 4/1985 | Shirose et al. | 430/124 |
| 4,515,460 | 5/1985 | Knechtel | 355/327 |
| 4,518,976 | 5/1985 | Tarumi et al. | 347/155 |
| 4,531,824 | 7/1985 | Landa | 355/285 |
| 4,531,825 | 7/1985 | Miwa et al. | 355/279 |
| 4,531,827 | 7/1985 | Tarumi et al. | 355/210 |
| 4,533,231 | 8/1985 | Shigenobu | 355/284 |
| 4,538,899 | 9/1985 | Landa et al. | 355/291 |
| 4,553,081 | 11/1985 | Koenck | 320/43 |
| 4,567,349 | 1/1986 | Henry et al. | 219/216 |
| 4,568,275 | 2/1986 | Sakurai | 432/60 |
| 4,585,319 | 4/1986 | Okamoto et al. | 355/200 |
| 4,607,940 | 8/1986 | Quang | 355/268 |
| 4,645,327 | 2/1987 | Kimura et al. | 355/200 |
| 4,653,897 | 3/1987 | Fromm | 355/290 |
| 4,671,643 | 6/1987 | Shigemura et al. | 355/282 |
| 4,684,238 | 8/1987 | Till et al. | 355/275 |
| 4,690,539 | 9/1987 | Radulski et al. | 355/326 |
| 4,708,460 | 11/1987 | Langdon | 355/271 |
| 4,709,202 | 11/1987 | Koenck et al. | 320/43 |
| 4,724,303 | 2/1988 | Martin et al. | 219/216 |
| 4,754,294 | 6/1988 | Kato | 347/140 |
| 4,755,849 | 7/1988 | Tarumi et al. | 355/290 |
| 4,763,158 | 7/1988 | Schlueter, Jr. | 355/284 |
| 4,794,651 | 12/1988 | Landa et al. | 430/110 |
| 4,796,048 | 1/1989 | Bean | 355/277 |
| 4,814,819 | 3/1989 | Torino et al. | 355/290 |
| 4,842,972 | 6/1989 | Tavernier et al. | 430/117 |
| 4,864,367 | 9/1989 | Nakahara et al. | 355/272 |
| 4,912,514 | 3/1990 | Mizutani | 355/272 |

FOREIGN PATENT DOCUMENTS

| | | |
|---|---|---|
| 1359730 | 7/1974 | United Kingdom . |
| 1409755 | 10/1975 | United Kingdom . |
| 1445143 | 8/1976 | United Kingdom . |
| 2027640 | 2/1980 | United Kingdom . |
| 2169416 | 7/1986 | United Kingdom . |
| 2176904 | 1/1987 | United Kingdom . |
| 9004216 | 4/1990 | WIPO . |

OTHER PUBLICATIONS

English Language Abstract of JP– 59–189381 (Abstract only considered).

IBM Bulletin vol. 21. No. 7 Dec. 1978; p. 2985 only considered.

English Language Abstract of Japanese Application No. 62–134674.

English Langauge Abstract of Japanese Application No. 62–240987.

English Language Abstract of Japanese Application No. 57–2048.

English Langauge Abstract of Japanese Application No. 61–117582.

IBM Technical Disclosure Bulletin, vol. 21, No. 7, Dec. 1978, p. 2985.

European Search Report and Annex.

IBM Bulletin vol. 21. No. 7 Dec. 1978; p. 2985 only considered.

METHOD AND APPARATUS FOR IMAGING USING AN INTERMEDIATE TRANSFER MEMBER

This application is a continuation of application Ser. No. 07/293,456, filed Jan. 4, 1989, now abandoned.

FIELD OF THE INVENTION

The present invention relates generally to imaging apparatus and techniques and more particularly to apparatus and techniques for transfer of images from an image-bearing surface to a substrate via an intermediate transfer medium.

BACKGROUND OF THE INVENTION

Various techniques for electrostatic image transfer are known in the patent literature. U.S. Pat. No. 4,684,238 describes intermediate transfer apparatus in which a plurality of liquid images, which include a liquid carrier having toner particles dispersed therein, are attracted from a photoconductive member to an intermediate belt. Liquid carrier is removed from the intermediate belt by vacuum apparatus and the toner particles are compacted on the intermediate belt in image configuration. Thereafter, the toner particles are transferred from the intermediate belt to the copy sheet in image configuration by electrostatic attraction.

U.S. Pat. No. 4,690,539 shows a system similar to that shown in U.S. Pat. No. 4,684,238 which is suitable for multi-color multiple-pass electrophoretic image transfer.

In U.S. Pat. Nos. 3,318,212 and 3,893,761 there are described methods and devices in which a powder image being transported on a resiliently deformable intermediate support surface is softened and thus rendered sticky while present on that surface and then is transferred and fixed onto a paper receiving support under the influence of pressure.

U.S. Pat. No. 4,015,027 describes an electrophotographic toner transfer and fusing method wherein a heated roller or belt is employed for pressure transfer of dry toner images from an intermediate transfer medium onto paper. At column 11, line 29–column 12 line 38 there appears a detailed discussion of heating of images upon transfer thereof as proposed therein and as taught in the prior art including specifically U.S. Pat. No. 3,591,276 to Byrne.

Reference is made to FIGS. 5*a*–5*c*, 6*a*–6*c*, 7*a* and 7*b* of U.S. Pat. No. 4,015,027. It is seen that in nearly all cases described, the toner is heated to at least its melting point during the transfer stage. In a technique proposed in U.S. Pat. No. 4,015,027 and exemplified by FIG. 6(*a*), the toner is heated to at least its melting point prior to the transfer zone. In the transfer zone, the toner cools below its melting point during transfer and fusion.

A belt construction characterized in that it has a very low heat capacitance and a thickness of between 15 and about 200 microns is proposed in U.S. Pat. No. 4,015,027. In one embodiment the belt comprises a 50 micron layer of aluminized Kapton having a 25 micron coating of silicon rubber. Another embodiment employs a 12.5 micron layer of stainless steel instead of the Kapton together with a silicon rubber coating. A reflecting layer is incorporated in the belt to reduce heating thereof.

Reference is now made to the following published patent applications and issued patents in the field of electrophotography: GB published Patent Applications Nos. 2,169,416A and 2,176,904A and U.S. Pat. Nos. issued 3,990,696, 4,233,381, 4,253,656, 4,256,820, 4,269,504, 4,278,884, 4,286,039, 4,302,093, 4,326,644, 4,326,792, 4,334,762, 4,350,333, 4,355,883, 4,362,297, 4,364,460, 4,364,657, 4,364,661, 4,368,881, 4,378,422, 4,392,742, 4,396,187, 4,400,079, 4,411,976, 4,412,383, 4,413,048, 4,418,903, 4,420,244, 4,435,068, 4,439,035, 4,454,215, 4,460,667, 4,473,865, 4,480,825, 4,501,486, 4,522,484, 4,531,824, 4,538,899, 4,582,774, 4,585,329, 4,586,810, 4,589,761, 4,598,992, 4,603,766, 4,620,699, 4,627,705, 4,678,317, the disclosures of which are incorporated by reference herein.

SUMMARY OF THE INVENTION

The present invention seeks to provide improved imaging apparatus.

There is thus provided in accordance with a preferred embodiment of the present invention apparatus for transfer of an image from an image bearing surface onto a substrate including an intermediate transfer member positioned in operative association with the image bearing surface, apparatus for transferring an image from the image bearing surface onto the intermediate transfer member and apparatus for transferring the image from the image bearing surface onto a substrate and being operative for heating the intermediate transfer member and the image so as to cause the image to adhere to the substrate and for cooling the intermediate transfer member sufficiently such that the adhesion of the image thereto is less than the cohesion of the image.

In accordance with one preferred embodiment of the invention, the image is a toner image and the apparatus for transferring the image from the image bearing surface onto a substrate is operative to heat the toner image to a temperature below its melting point.

Further in accordance with this embodiment of the invention the apparatus for transferring the image from the image bearing surface onto a substrate is operative to heat the toner image to a temperature at which the toner solvates.

Additionally in accordance with this embodiment of the invention the apparatus for transferring the image from the image bearing surface onto a substrate is operative to cool the intermediate transfer member to a temperature below the temperature at which the toner solvates.

Further in accordance with a preferred embodiment of the invention, the image may be a toner image and the apparatus for transferring the image from the image bearing surface onto a substrate may be operative to heat the toner image to a temperature at least as high as its melting point.

Additionally in accordance with this embodiment of the invention, the apparatus for transferring the image from the image bearing surface onto a substrate is operative to cool the intermediate transfer member to a temperature below the melting point of the toner.

Further in accordance with an embodiment of the invention the image may be a liquid toner image including particles and the apparatus for transferring the image from the image bearing surface onto a substrate is operative to heat the liquid toner image to a temperature below the melting point of said particles.

Additionally in accordance with this embodiment of the invention, the apparatus for transferring the image from the image bearing surface onto a substrate is operative to heat the liquid toner image to a temperature at which the toner solvates.

Further in accordance with an embodiment of the invention, the intermediate transfer member has low effective heat capacity such that the surface temperature of the intermediate transfer member is substantially reduced during transfer of an image therefrom onto a substrate.

There is also provided in accordance with a preferred embodiment of the invention apparatus for transfer of an image from an image bearing surface onto a substrate including an intermediate transfer member positioned in operative association with the image bearing surface, apparatus for transferring an image from the image bearing surface onto the intermediate transfer member and apparatus for transferring the image from the intermediate transfer member onto a substrate and being operative for heating the intermediate transfer member and the image so as to cause the image to adhere to the substrate and wherein the intermediate transfer member has low effective heat capacity such that the surface temperature of the intermediate transfer member is substantially reduced during transfer of an image therefrom onto a substrate.

Additionally in accordance with a preferred embodiment of the invention, the image is a liquid image including pigmented particles and the apparatus for transferring the image from the intermediate transfer member onto a substrate is operative to heat the liquid image to a temperature below the melting point of pigmented particles of the liquid image.

Further in accordance with the above embodiment, the apparatus for transferring the image from the intermediate transfer member onto a substrate is operative to heat the liquid image to a temperature at which the liquid image solvates.

Additionally in accordance with an embodiment of the invention, the image may be a liquid image including pigmented particles and the apparatus for transferring the image from the intermediate transfer member onto a substrate is operative to heat the liquid image to a temperature at least as high as the melting point of the pigmented particles of the liquid image.

Further in accordance with the above embodiment, the apparatus for transferring the image from the intermediate transfer member onto a substrate is operative to cool the intermediate transfer member to a temperature below the melting point of the pigmented particles of the liquid image.

Additionally in accordance with an embodiment of the invention, the apparatus for transferring the image from the intermediate transfer member onto a substrate is operative to increase the viscosity of the image during transfer thereof.

Further in accordance with an embodiment of the invention, the apparatus for transferring the image from the intermediate transfer member onto a substrate is operative to produced increased cohesion of the image during transfer thereof.

Additionally in accordance with a preferred embodiment of the present invention, the intermediate transfer member comprises a thin walled cylinder. According to a preferred embodiment of the invention, the thickness is less than 125 microns and preferably less than about 50 microns. One preferred embodiment comprises a layer of metalized polyester of about 25 microns and a release layer of Teflon of about 5 microns. Another embodiment comprises an approximately 5 micron layer of a nickel allow and an approximately 2 micron thick release layer of Teflon.

Further in accordance with the embodiments wherein the intermediate transfer member is a thin walled cylinder, the intermediate transfer member has low effective heat capacity such that the surface temperature of the intermediate transfer member is substantially reduced during transfer of an image therefrom onto a substrate.

Additionally in accordance with the above embodiment of the invention, the intermediate transfer member also comprises apparatus for axially tensioning the thin walled cylinder.

Further in accordance with the above embodiment, the intermediate transfer member also comprises apparatus for pneumatically pressurizing the thin-walled cylinder.

Additionally in accordance with the above embodiment, there is also provided apparatus for passing electrical current through the thin-walled cylinder for producing direct resistance heating thereof.

Additionally in accordance with a preferred embodiment of the present invention, the intermediate transfer member comprises a relatively heat conductive inner layer and a relatively heat insulative outer layer.

Further in accordance with the above embodiment, the intermediate transfer member has low effective heat capacity such that the surface temperature of the intermediate transfer member is substantially reduced during transfer of an image therefrom onto a substrate.

There is also provided in accordance with a preferred embodiment of the invention apparatus for transfer of multiple images from an image bearing surface onto a substrate including an intermediate transfer member positioned in operative association with the image bearing surface, apparatus for transferring multiple images from the image bearing surface onto the intermediate transfer member and apparatus for transferring multiple images from the intermediate transfer member onto a substrate and being operative for heating the intermediate transfer member and the image so as to cause the image to adhere to the substrate and for cooling the intermediate transfer member sufficiently such that the adhesion of the image thereto is less than the cohesion of the image adhering to the substrate.

Additionally in accordance with an embodiment of the invention, all of the various features described above in connection with the general apparatus for transfer of an image from an image bearing surface onto a substrate are provided also in the more specific embodiment for transfer of multiple images.

Further in accordance with an embodiment of the invention there is provided an intermediate transfer member for transfer of an image from an image bearing surface onto a substrate and comprising a thin walled cylinder having a thickness less than 125 microns.

Additionally in accordance with the foregoing embodiment, the thin walled cylinder has a thickness less than about 50 microns.

Further in accordance with the foregoing embodiment the thin walled cylinder has a thickness less than about 30 microns.

Additionally in accordance with the foregoing embodiment the thin walled cylinder comprises a layer of polyester and a thin release layer.

Further in accordance with the foregoing embodiment the thin walled cylinder comprises a layer of Kapton and a thin release layer.

Additionally in accordance with an embodiment of the invention the thin walled cylinder has a thickness less than about 7 microns.

Further in accordance with the foregoing embodiment, the thin walled cylinder comprises a metallic material.

Additionally in accordance with the foregoing embodiment the thin walled cylinder comprises a layer of nickel alloy and a thin release layer.

Further in accordance with the invention, the intermediate transfer member comprises apparatus for passing electrical current through said thin walled cylinder for producing direct resistance heating thereof.

Additionally in accordance with the invention, the intermediate transfer member also comprises means for axially tensioning said thin walled cylinder.

Further in accordance with the invention the intermediate transfer member comprises a pneumatically pressurized thin walled cylinder.

Additionally in accordance with an embodiment of the invention there is provided an intermediate transfer member for transfer of an image from an image bearing surface onto a substrate and comprising a relatively heat conductive inner layer and a relatively heat insulative outer layer.

Further in accordance with an embodiment of the invention the intermediate transfer member has a low effective heat capacity such that the surface temperature of the intermediate transfer member is substantially reduced during transfer of an image therefrom onto a substrate.

Additionally in accordance with a preferred embodiment of the invention there is provided a method for transfer of an image from an image bearing surface onto a substrate including the steps of positioning an intermediate transfer member in operative association with an image bearing surface, transferring an image from the image bearing surface onto the intermediate transfer member and transferring the image from the image bearing surface onto a substrate including the steps of heating the intermediate transfer member and the image so as to cause the image to adhere to the substrate and cooling the intermediate transfer member sufficiently such that the adhesion of the image thereto is less than the cohesion of the image.

In accordance with one preferred embodiment of the invention, the image is a toner image and the step of transferring the image from the intermediate transfer member onto a substrate is operative to heat the toner image to a temperature below its melting point.

Further in accordance with this embodiment of the invention the step of transferring the image from the intermediate transfer member onto a substrate is operative to heat the toner image to a temperature at which the toner solvates.

Additionally in accordance with this embodiment of the invention the step of transferring the image from the intermediate transfer member onto a substrate is operative to cool the intermediate transfer member to a temperature below the temperature at which the toner solvates.

Further in accordance with a preferred embodiment of the invention, the image may be a toner image and the step of transferring the image from the intermediate transfer member onto a substrate may be operative to heat the toner image to a temperature at least as high as its melting point.

Additionally in accordance with this embodiment of the invention, the step of transferring the image from the intermediate transfer member onto a substrate is operative to cool the intermediate transfer member to a temperature below the melting point of the toner.

Further in accordance with an embodiment of the invention the image may be a liquid toner image including particles and the step of transferring the image from the intermediate transfer member onto a substrate is operative to heat the liquid toner image to a temperature below the melting point of the particles.

Additionally in accordance with this embodiment of the invention, the step of transferring the image from the intermediate transfer member onto a substrate is operative to heat the liquid toner image to a temperature at which the toner solvates.

There is also provided in accordance with a preferred embodiment of the invention a method for transfer of an image from an image bearing surface onto a substrate including the steps of positioning an intermediate transfer member in operative association with the image bearing surface, transferring an image from the image bearing surface onto the intermediate transfer member and transferring the image from the intermediate transfer member onto a substrate and including the steps of heating the intermediate transfer member and the image so as to cause the image to adhere to the substrate and wherein the intermediate transfer member has low effective heat capacity such that the surface temperature of the intermediate transfer member is substantially reduced during transfer of an image therefrom onto a substrate.

Additionally in accordance with a preferred embodiment of the invention, the image is a liquid image including pigmented particles and the step of transferring the image from the intermediate transfer member onto a substrate is operative to heat the liquid image to a temperature below the melting point of pigmented particles of the liquid image.

Further in accordance with the above embodiment, the step of transferring the image from the intermediate transfer member onto a substrate is operative to heat the liquid image to a temperature at which the liquid image solvates.

Additionally in accordance with an embodiment of the invention, the image may be a liquid image including pigmented particles and the step of transferring the image from the intermediate transfer member onto a substrate is operative to heat the liquid image to a temperature at least as high as the melting point of the pigmented particles of the liquid image.

Further in accordance with the above embodiment, the step of transferring the image from the intermediate transfer member onto a substrate is operative to cool the intermediate transfer member to a temperature below the melting point of the pigmented particles of the liquid image.

Additionally in accordance with an embodiment of the invention, the step of transferring the image from the intermediate transfer member onto a substrate is operative to increase the viscosity of the image during transfer thereof.

Further in accordance with an embodiment of the invention, the step of transferring the image from the intermediate transfer member onto a substrate is operative to produce increased cohesion of the image during transfer thereof.

Further in accordance with an embodiment wherein the intermediate transfer member is a thin walled cylinder, there is also provided the step of axially tensioning the thin walled cylinder.

Further in accordance with the above embodiment, there may also be provided the step of pneumatically pressurizing the thin-walled cylinder.

Additionally in accordance with either of the above embodiments, the step of transferring may also include the step of passing electrical current through the thin-walled cylinder for producing direct resistance heating thereof.

There is also provided in accordance with a preferred embodiment of the invention a method for transfer of multiple images from an image bearing surface onto a substrate including the steps of positioning an intermediate transfer member in operative association with the image bearing surface, transferring multiple images from the intermediate transfer member onto the intermediate transfer member and transferring multiple images from the image bearing surface onto a substrate including the steps of heating the intermediate transfer member and the image so as to cause the image to adhere to the substrate and cooling the intermediate transfer member sufficiently such that the adhesion of the image thereto is less than the cohesion of the image adhering to the substrate.

Additionally in accordance with an embodiment of the invention, all of the various features described above in connection with the general method for transfer of an image from an image bearing surface onto a substrate are provided also in the more specific embodiment for transfer of multiple images.

BRIEF DESCRIPTION OF THE DRAWINGS

The present invention will be understood and appreciated more fully from the following detailed description taken in conjunction with the drawing in which.

DETAILED DESCRIPTION OF THE INVENTION

Figure 1:
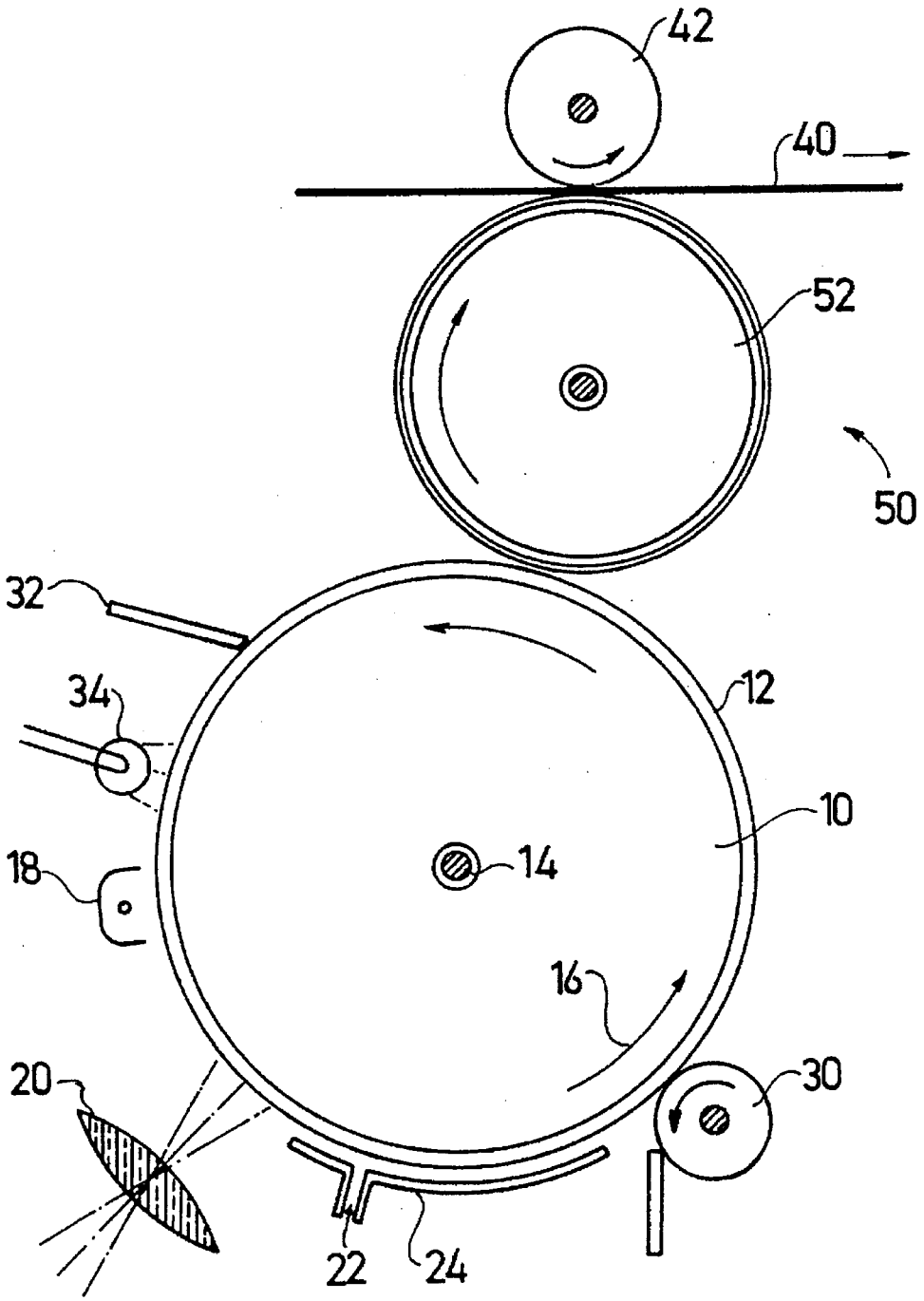
FIG. 1 is a generalized schematic sectional illustration of imaging apparatus constructed and operative in accordance with a preferred embodiment of the present invention.

Referring to FIG. 1 there is shown electrostatographic imaging apparatus in which the present invention may be employed and employing a liquid image forming composition. In a general sense, the imaging apparatus may comprise an electrostatographic printing machine or alternatively any other suitable type of imaging apparatus. Examples of systems in which the present invention may be employed include electrophotography, electrography, ionography, xero-printing, gravure-like printing and electrostatic printing.

For convenience, the description which follows is presented in the context of an electrophotographic system employing liquid toner, but without limiting the applicability of the present invention.

A metal drum 10, having formed thereon a photoconductive surface 12, is mounted on a shaft 14. Drum 10 is driven in the direction of arrow 16 such that the photoconductive surface 12 moves past a corona discharge device 18 adapted to charge the photoconductive surface 12. An image to be reproduced is focused by a lens 20 upon the photoconductive surface 12. The areas of the photoconductive surface 12 struck by light conduct the charge, or a portion thereof, to ground, thus forming an electrostatic latent image.

Developer liquid containing pigmented particles is circulated from any suitable source into a gap 22 defined between a development electrode 24 and the photoconductive surface 12. The development electrode 24 may be appropriately biased as known to the art, to assist in toning the electrostatic latent image as it passes into contact with the developer liquid.

Charged toner particles suspended in a carrier liquid, both of which form part of the developer liquid, travel by electrophoresis to the electrostatic latent image.

Excess liquid is removed from the developed image by metering apparatus which may incorporate a reverse roller indicated generally at reference numeral 30.

Transfer of the image to a carrier sheet 40, such as paper, supported by a platen roller 42, is effected by an intermediate transfer assembly 50 which is a subject of the present invention.

The transfer assembly 50 comprises an intermediate transfer element 52, typically in the form of a cylindrical roller. The intermediate transfer element 52 is preferably an intermediate transfer element of the type illustrated in any of FIGS. 4A–7B.

Transfer of the image from the photoconductive surface 12 to the intermediate transfer element 52 may take place in accordance with any suitable technique known in the prior art. Examples of suitable techniques are electrostatic transfer, heat transfer, pressure transfer, electrophoretic transfer and combinations thereof.

After the image is transferred from the photoconductive surface 12 to the intermediate transfer element 52, continued rotation of the photoconductive surface 12 in the direction of arrow 16 brings the surface past a conventional cleaning station 32 and a flood exposure light 34, for removing vestiges of prior images.

In accordance with a preferred embodiment of the invention the liquid toner image is heated on the intermediate transfer member 52. Heating of the image enhances its cohesiveness and renders it tacky, so as to enhance its adhesion to the substrate 40.

Although the invention is not limited in its application to specific materials or to liquid toner, the following specific example is provided for the purposes of illustration. There is employed a toner which is prepared in the following manner:

1000 g. Elvax II 5550 resin (DuPont) and 500 g. Isopar L were mixed in a Ross double planetary mixer for one hour at 90 degrees C., then for a further hour after addition of 250 g. Mogul L carbon black (Cabot) which had been wetted by 500 g. Isopar L, and finally for another hour after addition of 2000 g. Isopar L preheated to 110 degrees C. Stirring was continued in the absence of heating until the temperature reached 40 degrees C. 3050 grams of the resultant mixture was milled in a Sweco M-18 vibratory mill (containing 0.5" alumina cylinders) with 4000 g. Isopar L for 20 hours at 34 degrees C.; the average particle size of the product was 2.3 microns. The product was diluted to a 1.5% solids content with Isopar L and between 5–20 ml of 10% Lecithin charge director was added to the diluted dispersion.

Further in accordance with an embodiment of the invention, materials of the type described in published UK Patent specification GB 2,169,416A, the contents of which are hereby incorporated herein by reference, may be employed.

Figure 2A:
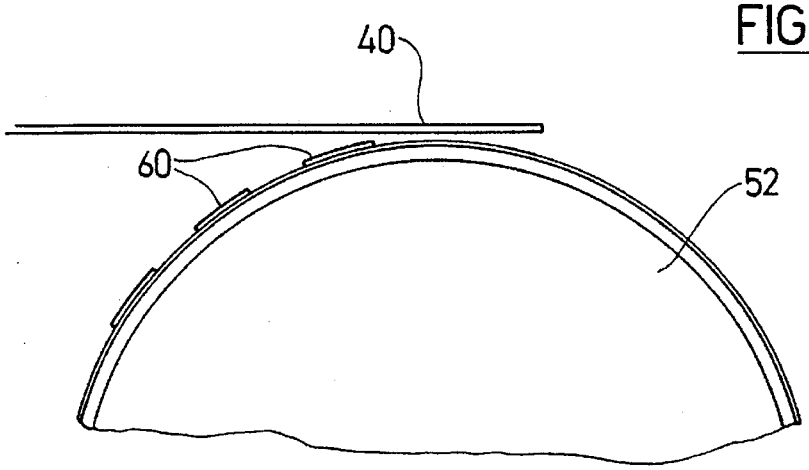
FIGS. 2A, 2B and 2C are illustrations of transfer of an image from an intermediate transfer element onto a substrate.

The image 60 located on the intermediate transfer element 52 is heated, by means which will be described hereinbelow. to a temperature which produces desired tackiness of the image. Then the image establishes contact with the substrate 40 as shown in FIG. 2A.

According to a preferred embodiment of the present invention, wherein a toner of the type described in detail on the preceding page, a toner of the type described in UK Patent specification GB 2,169,416A, or any other liquid toner which solvates at a temperature below its melting point is used, the image 60 is heated to a temperature below the melting point of the dry resin but above the temperature at which the resin swells or begin to solvate with the carrier liquid. Alternatively a liquid toner which does not solvate at a temperature below the melting point of the pigmented solid particles therein may be employed. In such a case, heating of the image to a temperature as high as the melting point of the pigmented solid particles therein is required.

Figure 2B:
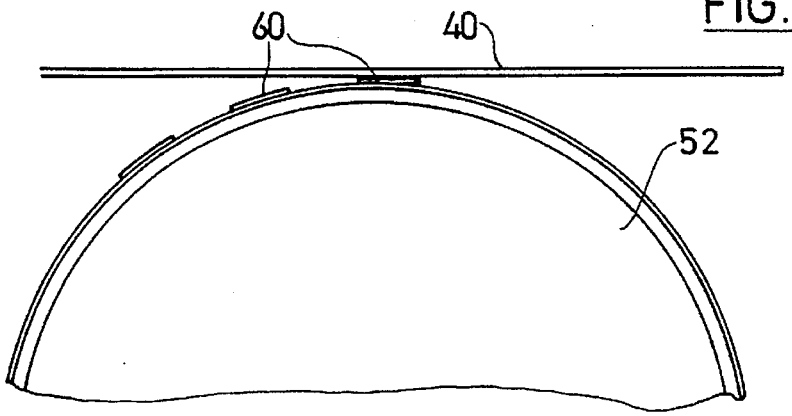
Figure 2C:
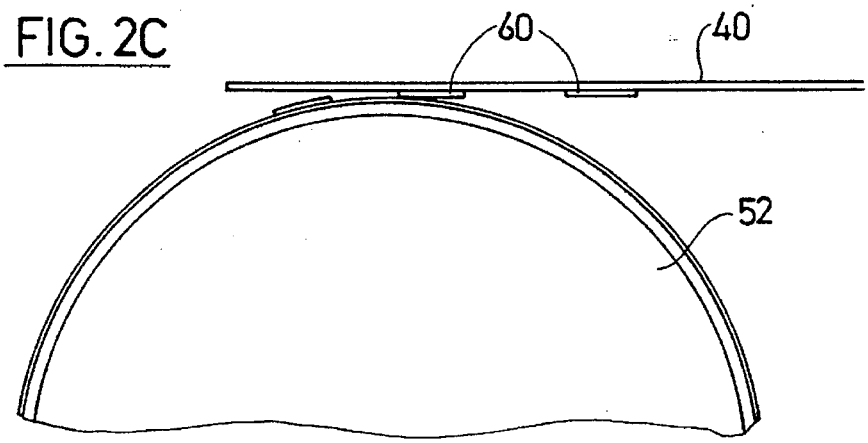

It is a particular Feature of the present invention that while the image 60 is in contact with both the element 52 and the substrate 40, as shown in FIG. 2B, for a duration which will be termed the "transfer duration", the heat transfer to the image from the element 52 and from the image to the substrate 40 which acts as a sink for the heat on the image is preferably such that the image is cooled, so as to increase its viscosity, while at least maintaining its cohesiveness. In this way, complete or nearly complete transfer of the image from the intermediate transfer element 52 to the substrate is realized. FIG. 2C illustrates the complete or nearly complete transfer of the image to the substrate 40.

If the specific materials discussed above are employed as an example, the following exemplary temperatures may be used. The image 60 and member 52 are initially heated to a temperature T 1 of 105 degrees C., which is below the melting point of the resin but above the solvation temperature. During the "transfer duration" temperature of the image/paper interface is reduced to a temperature T 2 of 85 degrees C., which is below the solvation temperature.

Figure 3:
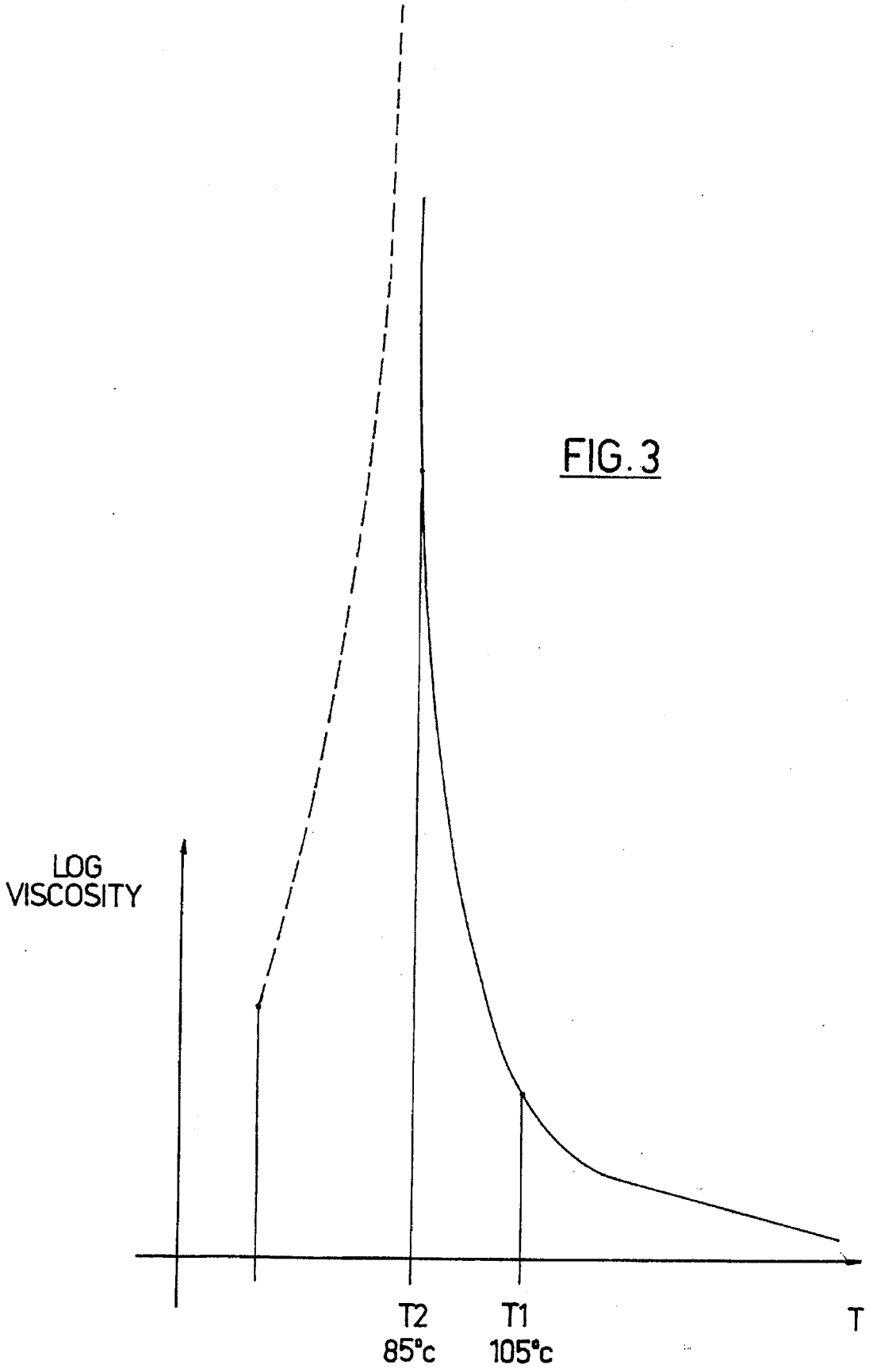
FIG. 3 is a generalized illustration of tackiness as a function of temperature.

Reference is made in this context to FIG. 3 which is an illustration, not necessarily to scale, of the dependence of viscosity of an image on temperature. It is seen that the reduction of temperature from T 1 to T 2 provides a corresponding significant rise in viscosity.

It will be appreciated that the image is initially heated to a temperature at which it solvates, so that it will adhere well to the substrate. The image is then cooled, increases its viscosity and thus increasing its cohesiveness. The adhesion of the image to the substrate is greater than its adhesion to the release coated intermediate transfer member, and the increased cohesion of the image preserves the integrity of the transferred image, providing substantially complete transfer of the image to the substrate.

Reference is now made to FIGS. 4A–7B which illustrate four alternative embodiments of intermediate transfer elements constructed and operative in accordance with a preferred embodiment of the invention.

According to a preferred embodiment of the invention, the intermediate transfer element comprises a thin-walled roller 70. Roller 70 preferably is formed of two rigid end portions 72 and 74 and a thin cylindrical layer 76 which, as shown in FIGS. 4–7, is unbacked by a solid structural support between said end portions and which is typically coated with a release layer 78. Typical materials and thicknesses are as follows:

Layer 76: metalized polyester

Thickness: 25 microns

Release layer 78: Teflon (DuPont)

Thickness: 5 microns

According to an alternative embodiment of the invention, the layer 76 may be a 5 micron thick film of nickel alloy, such as a nickel cobalt or nickel chromium alloy and the release layer may be a 2 micron thick layer of Teflon release material for the toner.

According to a further alternative embodiment of the invention, Kapton may be employed instead of polyester.

In accordance with a preferred embodiment of the invention, the thin cylindrical layer 76 is axially tensioned, as by a spring arrangement 80, sufficient to eliminate most surface irregularities. For the above-described example employing metalized polyester, for a cylinder of diameter 50 mm, a suitable tension is 10 Kg.

Further in accordance with a preferred embodiment of the invention, enhanced rigidity and surface uniformity of the thin-walled cylinder 70 is provided by pneumatically pressurizing the interior of the cylinder, by any suitable pressurized gas. A valve 82 may be provided for this purpose.

In accordance with a preferred embodiment of the present invention, the thin-walled cylinder 70 is heated by the passage of electrical current along layer 76 via conductors 84 and 86, which establish an electrical circuit via end portions 72 and 74. In this case layer 76 must either be or include a layer which is an electrical conductor of suitable characteristics.

In the above stated example, the electrical power required to provide desired heating of the intermediate transfer element 70 is relatively low.

Figure 5A:
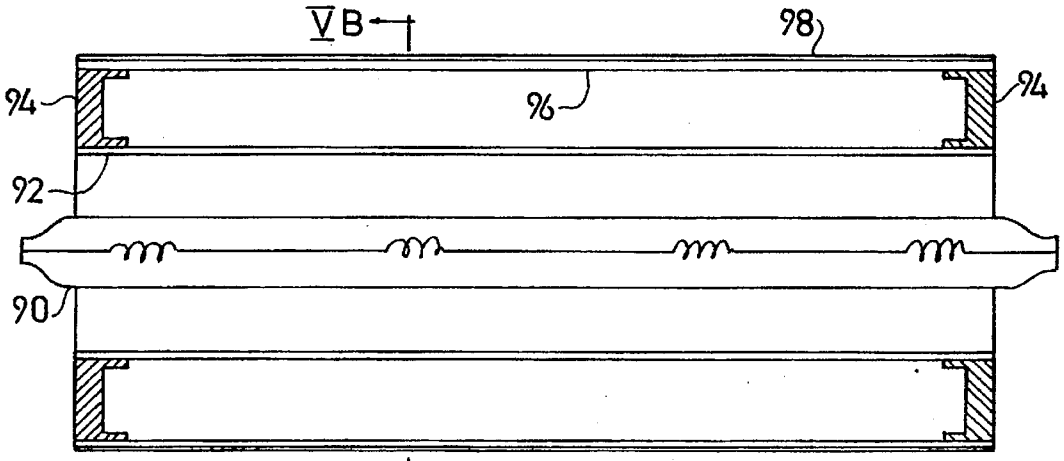
FIG. 5A is a side sectional illustration of a heated thin-walled intermediate transfer element constructed and operative in accordance with an alternative embodiment of the present invention.
Figure 5B:
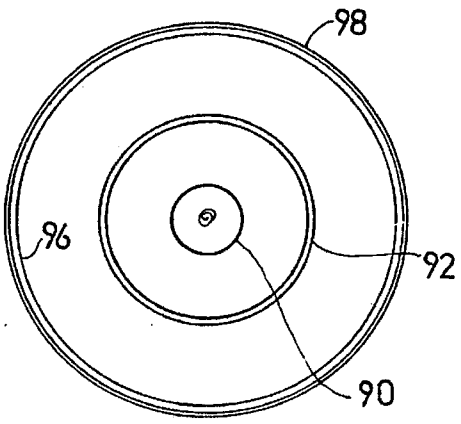
FIG. 5B is a sectional illustration taken along the lines V—V of FIG. 5A.

Reference is now made to FIGS. 5A and 5B which illustrate an alternative embodiment of a heated intermediate transfer element wherein heating is provided by radiation. Here a heating lamp 90 is disposed interior of a radiation transmissive tube 92, such as a quartz tube. Disposed in generally coaxial surrounding relationship with quartz tube 92 and supported on annular end supports 94 is an intermediate transfer layer 96 having formed thereon a release layer 98.

Figure 4A:
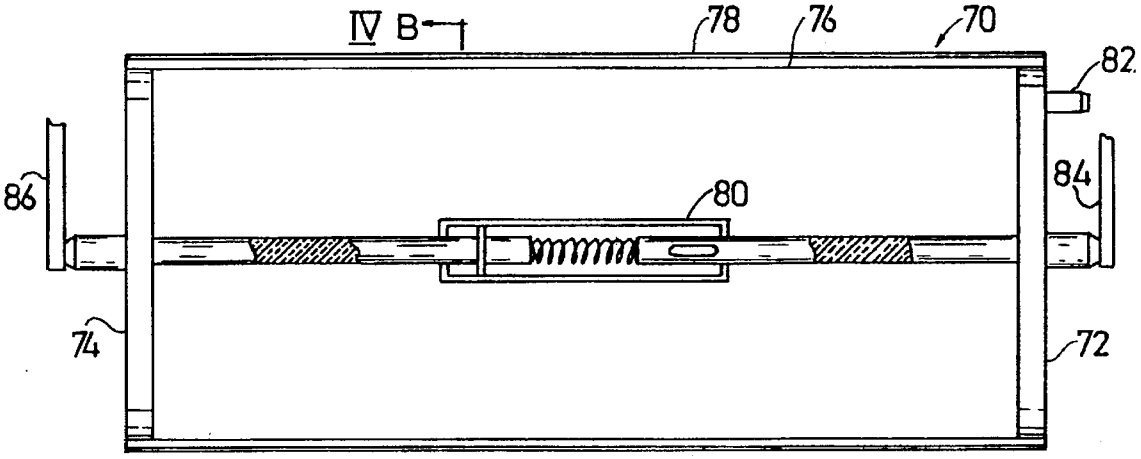
FIG. 4A is a side sectional illustration of a heated thin-walled intermediate transfer element constructed and operative in accordance with a preferred embodiment of the present invention.
Figure 4B:
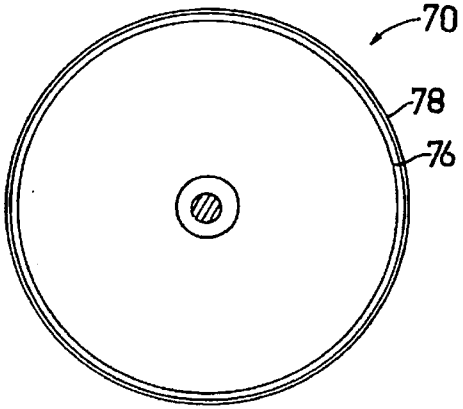
FIG. 4B is a sectional illustration taken along the lines IV—IV of FIG. 4A.

According to one embodiment of the invention, layers 96 and 98 may be identical to layers 76 and 78 in the embodiment of FIGS. 4A and 4B. In such a case tensioning apparatus of the type illustrated in FIG. 4A may be employed. Alternatively layers 96 and 98 which are more massive and thus more rigid than layers 76 and 78 may be employed. In such a case the release layer 98 is provided with sufficient thermal insulation capacity to limit the amount of thermal conduction therethrough so that during transfer of the image to the substrate 40, the image may be cooled as described above in connection with the thin-walled intermediate transfer element. Suitable materials and thicknesses for the non-thin-walled intermediate transfer element are as follows:

Layer 96: Aluminum

Thickness: 5 mm

Toner Release Layer 98: Silicone rubber

Thickness: 2 mm

Figure 6A:
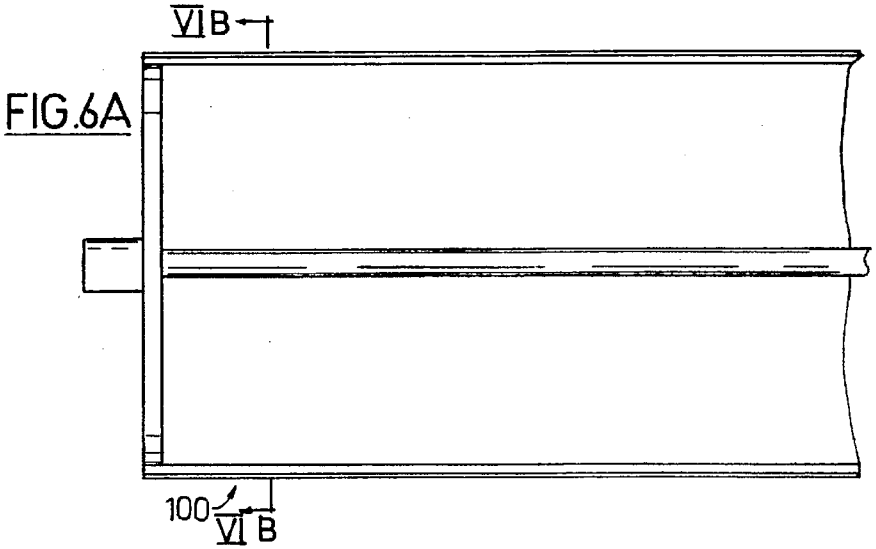
FIG. 6A is a side sectional illustration of a heated thin-walled intermediate transfer element constructed and operative in accordance with a further alternative embodiment of the present invention.
Figure 6B:
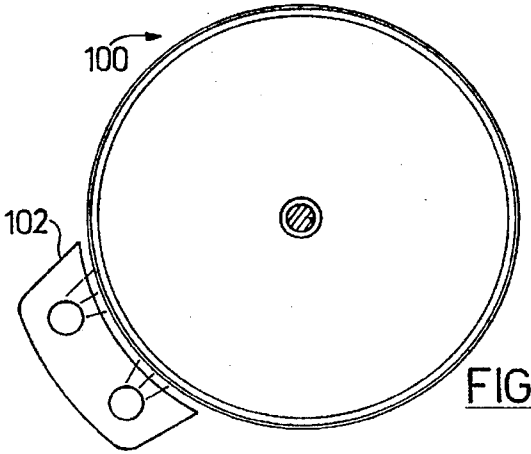
FIG. 6B is a sectional illustration taken along the lines VI—VI of FIG. 6A.

Reference is now made to FIGS. 6A and 6B, which illustrate an alternative arrangement of heated intermediate transfer roller. The roller 100 may be either of the thin-walled type or of the non-thin-walled type described above. Heating of the roller 100 is provided externally of the roller by a heating station 102. In the illustrated embodiment, the heating station 102 employs radiant heaters, which heat the roller by radiation. Alternatively the heating station 102 may heat the roller 100 by conduction through direct contact with the roller.

Figure 7A:
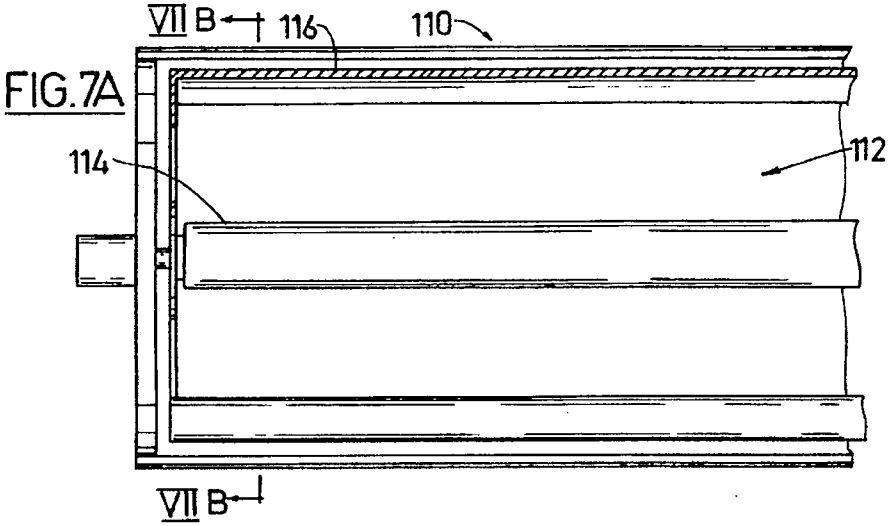
FIG. 7A is a side sectional illustration of a heated thin-walled intermediate transfer element constructed and operative in accordance with yet another embodiment of the present invention.
Figure 7B:
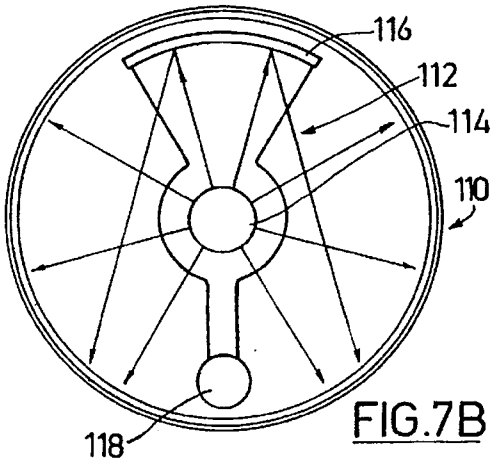
FIG. 7B is a sectional illustration taken along the lines VII—VII of FIG. 7A.

Reference is now made to FIGS. 7A and 7B, which illustrate a further alternative of heated intermediate roller arrangement. Here, once again, a roller 110 may be either thin-walled or non-thin-walled. Heating of the roller 110 is provided by an internal radiant heater assembly 112 which is mounted internally of roller 110. Radiant heater 112 comprises an elongate radiative heat source 114 which is associated with a reflector 116, which prevents direct radiation from source 114 from reaching the area at which the image is transferred from the roller 110 to substrate 40 (FIG. 1), thus providing differential heating of roller 110 and permitting cooling of the image during transfer as described hereinabove.

A suitable weight 118 may be mounted onto the reflector 116 so that when the reflector 116 and weight 118 are pivotably mounted with respect to the roller, they will retain the orientation illustrated, notwithstanding rotation of the roller 110.

It is a particular feature of the present invention that there is provided an intermediate transfer member including a thin surface which supports the image during transfer, the thin surface having an effective heat capacity per unit area which is less than that of the substrate.

The thin surface may be a cylindrical surface or alternatively an endless belt or any other configuration. Normally, due to its thinness, the thermal conductivity along the surface is sufficiently small such that the thermal mass of the supports, such as end rollers for a cylindrical surface like that shown in the drawings, may be disregarded.

It is a particular feature of the present invention that the effective thermal mass of the intermediate transfer element, as sensed by an object coming into contact with its outer surface is relatively small. This may be achieved either by the use of a thin-walled roller as described hereinabove, whose inherent thermal mass is limited, or alternatively by the use of a roller, other than a thin-walled roller, but having an outer layer which is a sufficiently good thermal insulator such that the heat transfer characteristics thereof are as required. Such a structure has been described above.

The advantages of the use of an intermediate transfer element having a low effective thermal mass may be summarized below:

a. enabling the image at the transfer region of the intermediate transfer element to be cooled during transfer, as has already been described;

b. enabling rapid cooling of the intermediate transfer element and thus eliminating the need for separating it from the photoconductor when operation is interrupted;

c. limiting the amount of thermal energy passed to the paper and thus reducing energy consumption and limiting paper deformation;

d. enabling differential heating of the intermediate transfer element such that it cools down from the onset of transfer to the onset of photoconductor contact to a temperature at which contact with the photoconductor will not cause photoconductor damage.

Figure 8:
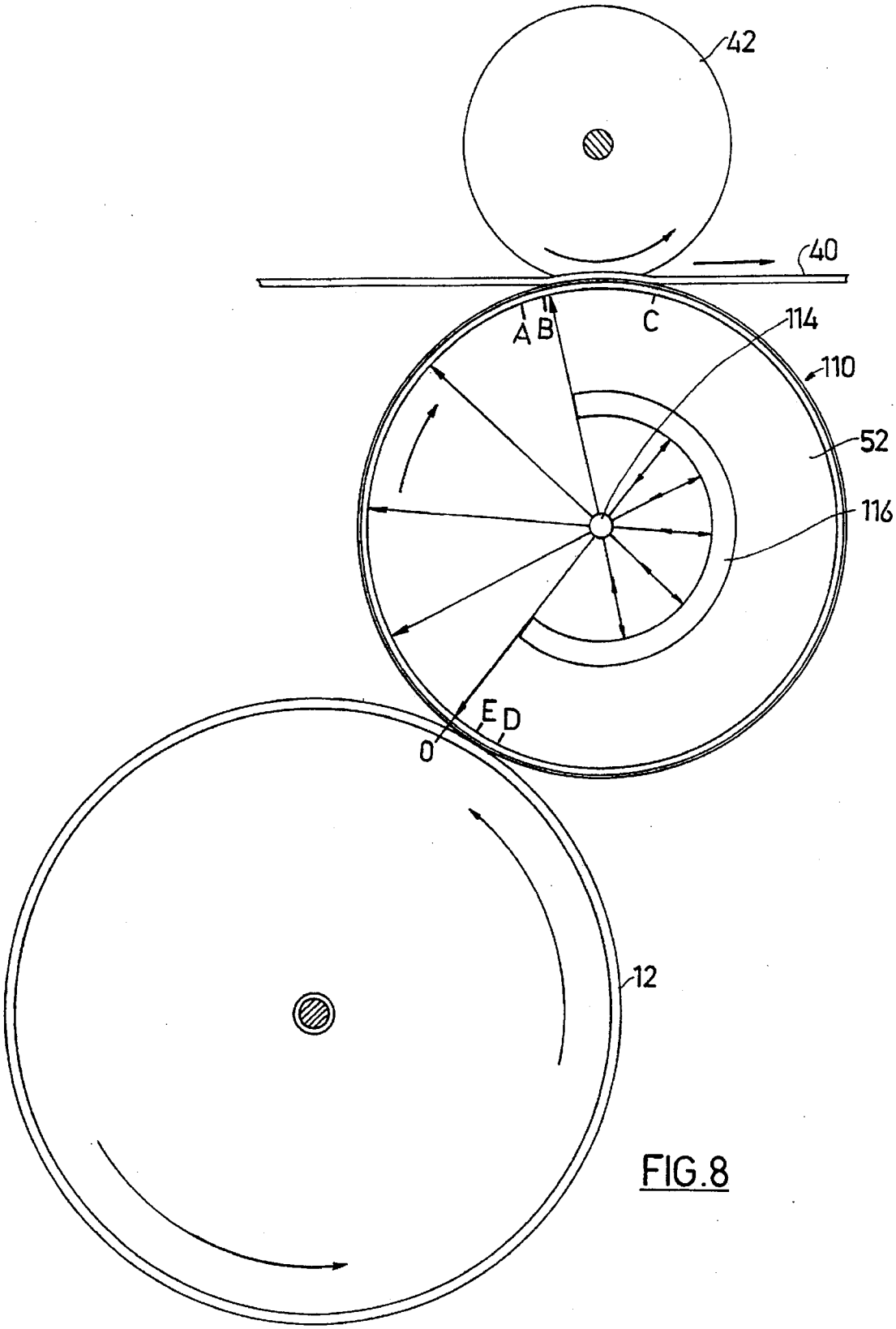
FIG. 8 is a sectional illustration of a partially heated intermediate transfer element.
Figure 9:
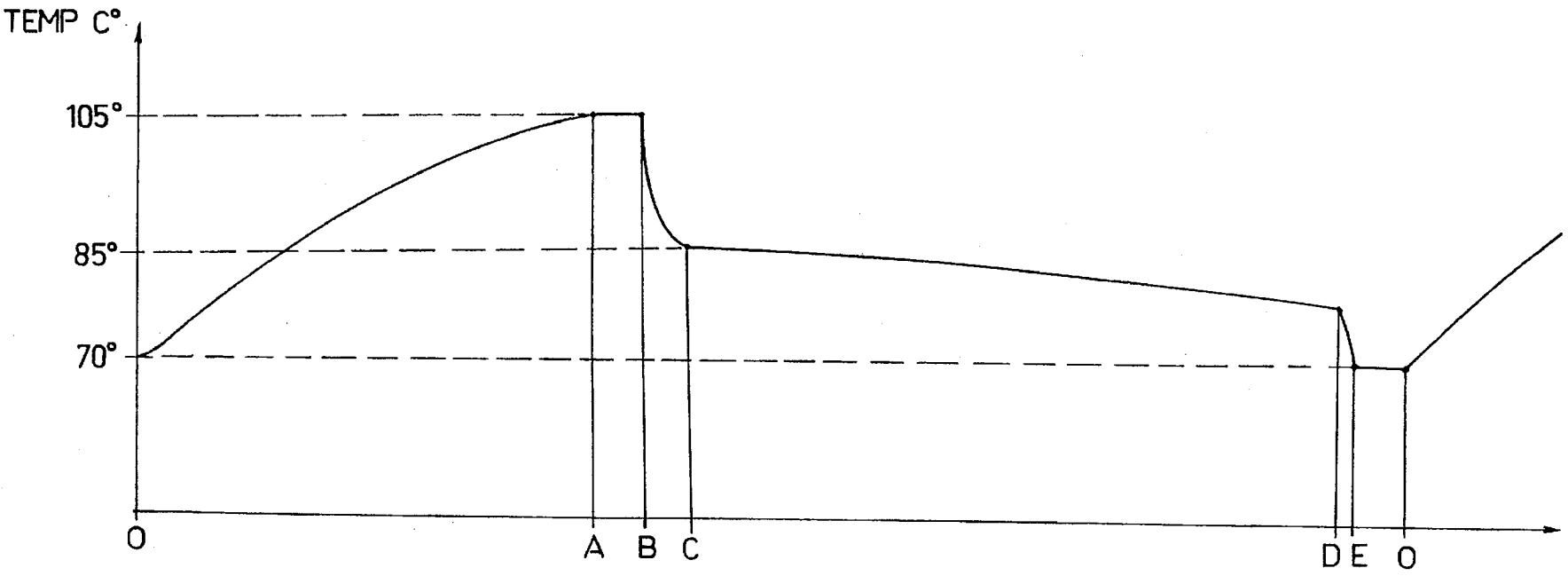
FIG. 9 is a graphical illustration of the temperature variation along a low thermal mass intermediate transfer element in an arrangement such as that illustrated in FIG. 8.

Reference is made in this context to FIG. 8 which illustrates a variation of the apparatus of FIGS. 7A and 7B, using identical reference numerals where appropriate, wherein a reflector is oriented so as to prevent direct radiation heating of the roller from the transfer stage through the photoconductor contact stage. In such a situation the approximate roller temperature at various locations thereallong is as shown in FIG. 9.

It can be seen from a consideration of FIGS. 8 and 9 that the intermediate transfer member gives up a measured quantity of heat to the substrate during image transfer thereto (between locations B and C) and remains at a relatively low temperature, i.e. below about 85 degrees centigrade, until it contacts the photoconductive surface 12, at which point it gives up further heat very quickly to the photoconductive surface 12 (between locations D and E). The photoconductive surface does not heat up appreciably in view of its relatively large thermal mass. The intermediate transfer member remains at generally the same temperature until it is exposed to radiation heating (at location O) and is heated gradually until it reaches a steady state temperature (at location A) just before transfer contact with the substrate (at location B).

It is a particular feature of the present invention that the temperature of the intermediate transfer member when it is in propinquity to the photoconductive surface 12 is sufficiently low as to preclude damage to the photoconductive surface 12, even during prolonged contact or propinquity, as when neither of the surfaces is rotating. Accordingly prior art mechanisms for separating the intermediate transfer member from the photoconductive surface 12 when the apparatus is not in operation are not required.

It will be appreciated by persons skilled in the art that the present invention is not limited by what has been particularly shown and described hereinabove. Rather the scope of the present invention is defined only by the claims which follow:

We claim:

1. Imaging apparatus comprising:

an image bearing surface having formed thereon a liquid image comprising carrier liquid and toner particles;

an intermediate transfer member positioned in operative association with the image bearing surface;

a first transfer station at which the liquid image is transferred from the image bearing surface onto the intermediate transfer member; and a second transfer station at which the liquid image is transferred from the intermediate transfer member onto a substrate including source of heat which heats the intermediate transfer member and the liquid image so as to cause the toner to adhere to the substrate and wherein the intermediate transfer member and the liquid image are cooled sufficiently such that the adhesion of the toner to the intermediate transfer member is less than the cohesion of the toner.

2. Apparatus according to claim 1 wherein the source of heat is operative to heat the liquid image to a temperature below the melting point of the toner.

3. Apparatus according to claim 2 wherein the toner solvates the carrier liquid at a solvation temperature above room temperature and the source of heat is operative to heat the image above the solvation temperature.

4. Apparatus according to claim 3 wherein said image is cooled to a temperature below said solvation temperature at the second transfer station.

5. Apparatus according to claim 4 wherein the heat source is operative to heat the liquid image to a temperature above the solvation temperature before contact with the substrate and wherein the image is cooled during contact with the substrate to a temperature below the solvation temperature.

6. Apparatus according to claim 5 wherein the substrate comprises a heat sink which cools the image to a temperature below said solvation temperature.

7. Apparatus according to claim 4 wherein the substrate comprises a heat sink which cools the image to a temperature below said solvation temperature.

8. Apparatus according to claim 1 wherein said intermediate transfer member comprises end portions and a thin walled cylinder which is unbacked by a solid structural support between said end portions.

9. Apparatus according to claim 8, wherein said thin walled cylinder has a thickness of less than 125 microns.

10. Apparatus according to claim 8, wherein said thin walled cylinder comprises a pneumatically pressurized thin wall cylinder, and further comprising means for axially tensioning said thin walled cylinder.

11. Apparatus according to claim 1 wherein said intermediate transfer member comprises a relatively heat conductive inner layer and a relatively heat insulative outer layer.

12. Apparatus according to claim 1 and wherein said intermediate transfer member has a low effective heat capacity such that the surface temperature of the intermediate transfer member is substantially reduced during transfer of an image therefrom onto a substrate.

13. Apparatus according to claim 1 wherein said intermediate transfer member has formed thereon a release coating for said toner particles.

14. Apparatus according to claim 1 wherein transfer of the toner particles to the intermediate transfer member is by electrostatic transfer.

15. Apparatus according to claim 14 wherein said intermediate transfer member has formed thereon a release coating for said toner.

16. Apparatus according to claim 14 wherein said intermediate transfer member has formed thereon a release coating.

17. Apparatus according to claim 1 wherein the substrate comprises a heat sink which cools the intermediate transfer member and the liquid image sufficiently such that the adhesion of the toner to the intermediate transfer member is less than the cohesion of the toner.

18. Imaging apparatus comprising:

an image bearing surface;

an intermediate transfer member positioned in operative association with the image bearing surface;

a developer which provides multiple liquid images on said image bearing surface the images comprising carrier liquid and toner;

a first transfer station at which said multiple liquid images are transferred from the image bearing surface onto the intermediate transfer member; and a second transfer station at which the multiple liquid images are transferred from the intermediate transfer member onto a substrate including a source of heat which heats the intermediate transfer member and the liquid image so as to cause the toner in the images to adhere to the substrate and wherein the intermediate transfer member and the liquid image are cooled sufficiently such that the adhesion of the toner to the intermediate transfer member is less than the cohesion of the toner.

19. Apparatus according to claim 18 wherein said intermediate transfer member has formed thereon a release coating for said toner.

20. Apparatus according to claim 18 wherein transfer of the toner to the intermediate transfer member is by electrostatic transfer.

21. Apparatus according to claim 20 wherein said intermediate transfer member has formed thereon a release coating for said toner particles.

22. Apparatus according to claim 20 wherein said intermediate transfer member has formed thereon a release coating.

23. Apparatus according to claim 18 wherein the substrate comprises a heat sink which cools the intermediate transfer member and the liquid image sufficiently such that the adhesion of the toner to the intermediate transfer member is less than the cohesion of the toner.

24. Imaging apparatus comprising:

an image bearing surface having a developed image formed thereon;

an intermediate transfer member positioned in operative association with the image bearing surface, wherein said intermediate transfer member comprised a thin walled cylinder having end portions and a cylindrical image transfer surface therebetween and wherein said thin walled cylinder is backed by a solid structural support at said end portions and which is unbacked by a solid structural support between said end portions and wherein said thin walled cylinder is a pneumatically pressurized thin walled cylinder;

a first transfer station at which the image is transferred from the image bearing surface onto the intermediate transfer member; and a second transfer station at which the image is transferred from the intermediate transfer member onto a substrate.

25. Apparatus according to claim 24 wherein said thin walled cylinder has a thickness less than about 50 microns.

26. Apparatus according to claim 25 wherein said thin walled cylinder has a thickness less than about 30 microns.

27. Apparatus according to claim 26 wherein said thin walled cylinder has a thickness less than about 7 microns.

28. Apparatus according to claim 26 and also comprising means for passing electrical current through said thin walled cylinder for producing direct resistance heating thereof.

29. Apparatus according to claim 25 wherein said thin walled cylinder comprises a layer of polyester and a thin release layer.

30. Apparatus according to claim 25 wherein said thin walled cylinder comprises a layer of Kapton and a thin release layer.

31. Apparatus according to claim 25, wherein said thin walled cylinder comprises a metallic material.

32. Apparatus according to claim 31, wherein said thin walled cylinder comprises a layer of nickel alloy and a thin release layer.

33. Apparatus according to claim 24 and further comprising means for axially tensioning said thin walled cylinder.

34. Apparatus according to claim 33, wherein said thin walled cylinder has a thickness of less than 125 microns.

35. Apparatus according to claim 34, wherein said thin walled cylinder has a thickness of less than 50 microns.

36. Apparatus according to claim 24, wherein said thin walled cylinder has a thickness of less than 125 microns.

37. Imaging apparatus comprising:

an image bearing surface;

an intermediate transfer member positioned in operative association with the image bearing surface, wherein said intermediate transfer member comprises a thin walled cylinder having end portions and a cylindrical image transfer surface therebetween and wherein said thin walled cylinder is backed by a solid structural support at said end portions and which is unbacked by a solid structural support between said end portions and wherein said thin walled cylinder is a pneumatically pressurized thin walled cylinder;

a developer which provides said multiple images on said image bearing surface the images comprising carrier liquid and toner;

a first transfer station at which said multiple images are transferred from the image bearing surface onto the intermediate transfer member; and a second transfer station at which the multiple images are transferred from the intermediate transfer member onto a substrate.

38. Apparatus according to claim 37, wherein said thin walled cylinder has a thickness of less than 125 microns.

39. Apparatus according to claim 37, further comprising means for axially tensioning said thin walled cylinder.

40. Imaging apparatus comprising:

an image bearing surface having a developed image formed thereon;

an intermediate transfer member positioned in operative association with the image bearing surface, wherein said intermediate transfer member comprises a thin walled cylinder having end portions and a cylindrical image transfer surface therebetween end wherein said thin walled cylinder is backed by a solid structural support at said end portions and which is unbacked by a solid structural support between said end portions and wherein said intermediate transfer member includes means for axially tensioning said thin wall cylinder;

a first transfer station at which the image is transferred from the image bearing surface onto the intermediate transfer member; and a second transfer station at which the image is transferred from the intermediate transfer member onto a substrate.

41. Apparatus according to claim 40, wherein said thin walled cylinder has a thickness of less than 125 microns.

42. Apparatus according to claim 40, wherein said thin walled cylinder comprises a pneumatically pressurized thin wall cylinder.

43. An intermediate transfer member for transfer of an image from an image bearing surface onto a substrate and comprising a thin walled cylinder having end portions and a cylindrical image transfer surface therebetween and wherein said than walled cylinder has a thickness of less than 125 microns which is which is backed by a solid structural support at said end portions and which is unbacked by a solid structural support between said end portions.

44. An intermediate transfer member for transfer of an image from an image bearing surface onto a substrate and comprising a thin walled cylinder having end portions and a cylindrical image transfer surface therebetween and wherein said thin walled cylinder is backed by a solid structural support at said end portions and which is unbacked by a solid structural support between said end portions and wherein said intermediate transfer member also comprises means for axially tensioning said thin walled cylinder.

45. An intermediate transfer member according to claim 44 and wherein said thin walled cylinder has a thickness less than about 50 microns.

46. Apparatus according to claim 45 wherein said thin walled cylinder has a thickness less than about 30 microns.

47. An intermediate transfer member according to claim 46 wherein said thin walled cylinder has a thickness less than about 7 microns.

48. An intermediate transfer member according to claim 46, wherein said thin walled cylinder comprises a metallic material.

49. An intermediate transfer member according to claim 48, wherein said thin walled cylinder comprises a layer of nickel alloy and a thin release layer.

50. An intermediate transfer member according to claim 46 and also comprising means for passing electrical current through said thin walled cylinder for producing direct resistance heating thereof.

51. An intermediate transfer member according to claim 45 wherein said thin walled cylinder comprises a layer of polyester and a thin release layer.

52. An intermediate transfer member according to claim 45 wherein said thin walled cylinder comprises a layer of Kapton and a thin release layer.

53. Member according to claim 44, wherein said thin walled cylinder has a thickness of less than 125 microns.

54. An intermediate transfer member according to claim 44, wherein said thin walled cylinder comprises a pneumatically pressurized thin walled cylinder.

55. An intermediate transfer member according to claim 54, wherein said thin walled cylinder has a thickness of less than 125 microns.

56. An intermediate transfer member according to claim 55, wherein said thin walled cylinder has a thickness of less than 50 microns.

57. An intermediate transfer member for transfer of an image from an image bearing surface onto a substrate and comprising a thin walled cylinder having end portions and a cylindrical image transfer surface therebetween and wherein said thin walled cylinder is backed by a solid structural support at said end portions and which is unbacked by a solid structural support between said end portions and wherein said thin walled cylinder is a pneumatically pressurized thin walled cylinder.

58. An intermediate transfer member according to claim 57 and wherein said intermediate transfer member has a low effective heat capacity such that the surface temperature of the intermediate transfer member is substantially reduced during transfer of an image therefrom onto a substrate.

59. An intermediate transfer member according to claim 57 wherein said thin walled cylinder has a thickness of less than about 50 microns.

60. An intermediate transfer member according to claim 59 wherein said thin walled cylinder has a thickness of less than about 30 microns.

61. An intermediate transfer member according to claim 60 and also comprising means for passing electrical current through said thin walled cylinder for producing direct resistance heating thereof.

62. An intermediate transfer member according to claim 59 wherein said thin walled cylinder comprises a layer of polyester and a thin release layer.

63. An intermediate transfer member according to claim 59 wherein said thin walled cylinder comprises a layer of Kapton and a thin release layer.

64. An intermediate transfer member according to claim 59 wherein said thin walled cylinder has a thickness less than about 7 microns.

65. An intermediate transfer member according to claim 64 wherein said thin walled cylinder comprises a metallic material.

66. An intermediate transfer member according to claim 65, wherein said thin walled cylinder comprises a layer of nickel alloy and a thin release layer.

67. An intermediate transfer member according to claim 57, wherein said thin walled cylinder has a thickness of less than 125 microns.

68. A method for transfer of a liquid image from an image bearing surface onto a substrate comprising:

providing a liquid image on said image bearing surface, the liquid image comprising carrier liquid and toner;

positioning an intermediate transfer member in operative association with the image bearing surface;

first transferring said liquid image from the image bearing surface onto the intermediate transfer member; and subsequently transferring the liquid image from the intermediate transfer member onto a substrate and including heating the intermediate transfer member and heating the liquid image so as to cause the toner to adhere to the substrate and cooling the intermediate transfer member sufficiently such that the adhesion of the toner thereto is less than the cohesion of the toner.

69. A method according to claim 68 wherein heating the liquid toner image includes heating the liquid toner image to a temperature below the melting point of the toner.

70. A method according to claim 69 wherein heating the liquid toner image includes heating said image to a temperature at which it solvates.

71. A method according to claim 70 wherein cooling the intermediate transfer member includes cooling said image to below said temperature at which it solvates.

72. A method according to claim 68 wherein said intermediate transfer member comprises a thin walled cylinder in which electrical current is passed through for producing direct resistance heating thereof.

73. A method according to claim 68 wherein said intermediate transfer member comprises a thin walled cylinder which is axially tensioned.

74. A method according to claim 68 wherein said intermediate transfer member comprises a thin walled cylinder which is pneumatically pressurized.

75. A method according to claim 68 wherein said intermediate transfer member has a low effective heat capacity such that the surface temperature of the intermediate transfer member is substantially reduced during transfer of an image therefrom onto a substrate.

76. A method according to claim 68 wherein said intermediate transfer member has formed thereon a release coating for said toner.

77. A method according to claim 68 wherein said intermediate transfer member has formed thereon a release coating.

78. An imaging method comprising:

sequentially providing multiple liquid images on an image bearing surface, the liquid images comprising carrier liquid and toner;

positioning an intermediate transfer member in operative association with the image bearing surface;

transferring the multiple liquid images from the image bearing surface onto the intermediate transfer member; and transferring the multiple liquid images from the intermediate transfer member onto a substrate and including heating the intermediate transfer member and heating the liquid images so as to cause the toner in the images to adhere to the substrate and cooling the intermediate transfer member sufficiently such that the adhesion of the toner thereto is less than the cohesion of the toner.

79. A method according to claim 78 wherein said intermediate transfer member has formed thereon a release coating for said toner.

80. A method according to claim 78 wherein transfer of the toner to the intermediate transfer member is by electrostatic transfer.

81. An imaging apparatus for printing an image from a latent image formed on a latent image bearing surface comprising:

developing means for developing said latent image with a liquid developer, comprising carrier liquid and charged pigmented particles, to form a developed image;

an intermediate transfer member having formed thereon a release coating for the pigmented particles and which receives said developed image from said latent image bearing surface for subsequent transfer to a final substrate; and a heat source which heats said developed image during its transfer from said latent image bearing surface to said intermediate transfer member.

82. Imaging apparatus according to claim 81 further comprising:

means for further heating said image prior to said subsequent transfer to said final substrate.

83. Imaging apparatus according to claim 81, and comprising:

a transfer station at which electrostatic transfer of the charged pigmented particles to the intermediate transfer member takes place.

84. A method for forming an image on a final substrate from a latent image on an image forming surface comprising:

developing said latent image using a liquid developer comprising carrier liquid and charged particles to form a liquid toner image at a first temperature; and transferring said liquid toner image to an intermediate transfer member having thereon a release coating for said charged particles, said liquid toner image being at a higher temperature during said transfer step than said first temperature.

85. A method according to claim 84 comprising:

further transferring said liquid toner image from said intermediate transfer member to a final substrate, said liquid toner image being at a higher temperature during said further transferring step than during said transferring step.

86. A method according to claim 84 wherein said transfer is by electrophoresis.

87. Imaging apparatus comprising:

an image bearing surface having formed thereon a liquid image comprising carrier liquid and toner which solvates the carrier liquid at a solvation temperature above room temperature;

an intermediate transfer member positioned in operative association with the image bearing surface;

a first transfer station at which the liquid image is transferred from the image bearing surface onto the intermediate transfer member; and a second transfer station at which the liquid image is transferred from the intermediate transfer member onto a substrate including a source of heat which heats the liquid toner image to a temperature above the solvation temperature, below the melting point of the toner and below the boiling point of the carrier liquid prior to the transfer of the image to the substrate.

88. Apparatus according to claim 87 wherein the intermediate transfer member and the heated liquid image are cooled sufficiently, at the second transfer station, such that the adhesion of the toner to the intermediate transfer member is less than the cohesion of the toner.

89. Apparatus according to claim 88 wherein the heated liquid toner image is cooled to a temperature below the solvation temperature at the second transfer station.

90. Apparatus according to claim 89 wherein the heat source is operative to heat the image such that it remains above the solvation temperature until contact of the image with the substrate.

91. Apparatus according to claim 89 wherein the substrate comprises a heat sink which cools the image to a temperature below said solvation temperature.

92. Apparatus according to claim 88 wherein the substrate comprises a heat sink which cools the intermediate transfer member and the liquid image sufficiently such that the adhesion of the toner to the intermediate transfer member is less than the cohesion of the toner.

93. A method for forming an image on a final substrate from at least one latent image formed on at least one image forming surface comprising:

developing a latent image using a liquid developer, comprising carrier liquid and charged toner particles, to form a first liquid toner image; and transferring said liquid toner image to an intermediate transfer member coated with a release coating for the toner particles, said liquid toner image being at a higher temperature during said transfer than during said development.

94. A method according to claim 93 wherein the transfer to the intermediate transfer member is by electrostatic transfer.

95. An imaging apparatus for printing an image from a latent image formed on a latent image bearing surface comprising:

developing means for developing said latent image with a liquid developer, which comprises carrier liquid and charged pigmented particles, to form a developed image;

an intermediate transfer member having formed thereon a release coating which receives said developed image from said latent image bearing surface prior to subsequent transfer to a final substrate; and a heat source which heats said developed image during its transfer from said latent image bearing surface to said intermediate transfer member.

96. Imaging apparatus according to claim 95, and comprising:

a transfer station at which electrostatic transfer of the charged pigmented particles to the intermediate transfer member takes place.

97. A method for forming an image on a final substrate from a latent image on an image forming surface comprising:

developing said latent image using a liquid developer, which comprises carrier liquid and charged particles, to form a liquid toner image at a first temperature; and transferring said liquid toner image to an intermediate transfer member having thereon a release coating, said liquid toner image being at a higher temperature during said transfer than said first temperature.

98. A method according to claim 97 wherein said transfer is by electrophoresis.

99. A method for forming an image on a final substrate from at least one latent image formed on at least one image forming surface comprising:

developing a latent image using a liquid developer, comprising carrier liquid and charged toner particles, to form a liquid toner image; and transferring said liquid toner image to an intermediate transfer member coated with a release coating for the toner particles, said liquid toner image being at a higher temperature during said transfer than during said development.

100. A method according to claim 99 wherein said transfer is by electrophoresis.

101. A method for forming an image on a final substrate from at least one latent image formed on at least one image forming surface comprising:

developing a latent image using a liquid developer, comprising carrier liquid and charged toner particles, to form a liquid toner image; and electrostatically transferring said liquid toner image to an intermediate transfer member, said liquid toner image being at a higher temperature during said transfer than during said development.

* * * * *